US010683124B2

(12) United States Patent
Nelson et al.

(10) Patent No.: US 10,683,124 B2
(45) Date of Patent: Jun. 16, 2020

(54) STRETCH WRAP DISPENSER WITH CUTTING AND GATHERING MECHANISMS

(71) Applicant: Encore Packaging LLC, Lake Bluff, IL (US)

(72) Inventors: Timothy H. Nelson, Winnetka, IL (US); John Parks, Mundelein, IL (US)

(73) Assignee: Encore Packaging LLC, Vernon Hills, IL (US)

( * ) Notice: Subject to any disclaimer, the term of this patent is extended or adjusted under 35 U.S.C. 154(b) by 362 days.

(21) Appl. No.: 15/494,739

(22) Filed: Apr. 24, 2017

(65) Prior Publication Data

US 2017/0305583 A1 Oct. 26, 2017

Related U.S. Application Data

(60) Provisional application No. 62/326,424, filed on Apr. 22, 2016.

(51) Int. Cl.

| | |
|---|---|
| ***B65B 67/08*** | (2006.01) |
| ***B65H 16/00*** | (2006.01) |
| *B65B 41/12* | (2006.01) |

(52) U.S. Cl.

CPC ..... *B65B 67/085* (2013.01); *B65H 16/005* (2013.01); *B65B 41/12* (2013.01); *B65H 2301/5155* (2013.01); *B65H 2701/1944* (2013.01)

(58) Field of Classification Search

CPC ..... B65H 16/005; B65H 67/085
USPC ..... 57/31, 260
See application file for complete search history.

(56) References Cited

U.S. PATENT DOCUMENTS

| | | | | |
|---|---|---|---|---|
| 2,256,151 | A * | 9/1941 | Martin | D02G 3/08 57/31 |
| 3,230,584 | A * | 1/1966 | Kalwaites | D01G 15/52 19/150 |
| 3,287,892 | A * | 11/1966 | Rapoza | D02G 3/324 57/225 |
| 3,664,115 | A * | 5/1972 | Watson | D02J 1/18 57/31 |
| 4,697,407 | A * | 10/1987 | Wasserman | D01D 5/42 428/372 |
| 5,168,685 | A * | 12/1992 | Suzuki | B65B 11/045 53/141 |
| 6,874,396 | B2 * | 4/2005 | Sanda | B65H 18/106 226/176 |
| 7,581,368 | B1 * | 9/2009 | Bison | B65B 11/006 53/399 |
| 8,707,664 | B1 * | 4/2014 | Bison | B65B 11/585 53/441 |

(Continued)

*Primary Examiner* — Shaun R Hurley

(74) *Attorney, Agent, or Firm* — Fitch, Even, Tabin & Flannery LLP

(57) ABSTRACT

A stretch wrap applicator includes one or more cutting members arranged to engage the stretch wrap to cut it into strips as it is dispensed from the roll. The strips are then gathered and stretched into strings that are wrapped around the object. A roller is biased toward the stretch wrap roll to ensure an even flow of stretch film from the roll and more consistent tension on the film dispensed from the roll. The roller includes a groove. A cutting member is disposed to rest in the groove such that stretch film passes over and around the roller as it is dispensed from the roll and then engages the cutting member in the grove before the stretch film separates from the roller.

3 Claims, 6 Drawing Sheets

(56) References Cited

U.S. PATENT DOCUMENTS

| | | | | |
|---|---|---|---|---|
| 2014/0109523 | A1* | 4/2014 | Nelson | B65B 61/02 53/461 |
| 2014/0109524 | A1* | 4/2014 | Nelson | B65B 61/00 53/462 |
| 2014/0109525 | A1* | 4/2014 | Nelson | B65B 61/00 53/462 |
| 2014/0331609 | A1* | 11/2014 | Bison | B65B 11/006 53/441 |
| 2015/0203232 | A1* | 7/2015 | Nelson | B65B 67/085 242/422.4 |
| 2016/0355293 | A1* | 12/2016 | Clarke | B65B 59/04 |

* cited by examiner

STRETCH WRAP DISPENSER WITH CUTTING AND GATHERING MECHANISMS

RELATED APPLICATIONS

This application claims the benefit of U.S. provisional patent application No. 62/326,424 filed Apr. 22, 2016, which is incorporated by reference herein in its entirety.

TECHNICAL FIELD

The invention relates generally to the packaging industry and, more specifically, to application of stretch film or wrap to objects.

BACKGROUND

Stretch film or wrap is generally known in the industry as a material that can be used to securely wrap a collection of objects together using the stretch material's resiliency and dinginess. Stretch wrap is typically understood to be a polyethylene stretch film that is generally dispensed from a roll form for use in a variety of applications. For instance, stretch wrap is held against a collection of objects and dispensed and stretched around the collection of objects and wrapped over itself up to several times to cover and hold together the collection of objects. In the shipping industry, for example, a collection of materials may be placed on a pallet to secure such articles together during the shipping process. A collection of boxes placed on a pallet can be shipped as a single cohesive unit when bound together through wrapping with stretch wrap. Other applications of stretch wrap are known such as wrapping agricultural products or simply binding together a collection of items.

Although such usages for stretch wrap are well known and documented, the amount of stretch wrap used in any given application can be extensive. For example, for an industrial supplier that ships large numbers of pallets of materials out on a consistent basis, a large inventory of stretch wrap must be maintained to facilitate the regular shipment of such products. For example, a large amount of stretch film may be necessary to wrap a given pallet of materials.

Typically, during application, a tension is applied to the stretch film as it is applied to the objects being wrapped. This tension stretches the film to facilitate a secure binding of the wrapped objects together, and this tension process also both strengthens the stretch film and allows for the use of less film. One known device includes an idler roller that engages and rotates with the stretch wrap as it is pulled from its roll. The idler roller facilitates stretching of the wrap along its length due to the tension on the film. The roller also generally maintains the film's flat shape as it engages the object around which it is being wrapped. Although this stretch is advantageous, further stretch and strength is still desirable. Another known approach is to stretch the stretch wrap with tension in the long direction while holding the sides of the stretch wrap to reduce narrowing. Such an approach is largely done through complex and expensive machinery.

Another common application for stretch film is the containment and shipment of agricultural products where these products need to be ventilated to avoid spoilage or for evaporation of water. Current applications use stretch film that has holes cut into the film to allow the film to breath. This process is either done in-line during the manufacturing of the stretch film with expensive equipment or done off line as a secondary operation using expensive equipment to wind, perforate, and then rewind the film. Another known approach includes gathering the stretch film into ropes or strings after dispensing. For example, a dispensed stretch film can be cut into individual sections that are then individually gathered into strings that can be used for securing packaged items. This roping or stringing process, however, can be complicated by uneven dispensing of the stretch film from its roll, resulting in uneven cutting of the film or jamming of the film at the cutting device.

SUMMARY

Generally speaking and pursuant to these various embodiments, a stretch wrap manipulator is provided that includes one or more cutting members arranged, for instance, in parallel and designed to engage the stretch wrap to cut it into strips as it is dispensed from the roll. The roll is engaged by a roller biased against the stretch wrap roll. The roller's pressure against the stretch wrap roll ensures an even flow of stretch film from the roll and more consistent tension on the film dispensed from the roll. The roller includes a groove. A cutting member is disposed to rest in the groove such that stretch film passes over and around the roller as it is dispensed from the roll and then engages the cutting member in the grove before the stretch film separates from the roller. Gathering mechanisms are disposed to receive and gather the cut strips of stretch film into strings that are wrapped around the object. Optionally, the two cut strips engage and roll over second and third rollers, respectively, to further stretch the material before engaging the respective gathering mechanisms. The strings formed from the stretch wrap can stretch to an extended length while maintaining excellent tensile strength to secure heavy loads. Accordingly, such approaches more reliably and consistently provide the strings made from stretch film that save on the volume of stretch wrap used to secure a load without significantly compromising strength as a result of the stretching action while gathering the strips into strings. Moreover, by disposing the cutting member partially in a groove, accidental injuries related to the cutting member may be reduced.

In one described example, one or more cutting blades are disposed along a width of the stretch wrap where it separates from the roll. Beyond the cutting blades are gathering devices that gather individual strips of the stretch wrap into strings. The end of the stretch wrap is engaged to the object being wrapped such that the stretch wrap is under tension as it is removed from the roll, cut, and gathered into strings. The gathering devices apply this tension to the strips to stretch the strips as they are gathered together into the strings while passing through the gathering devices. This stretching can effect a significant increase in the length of the stretch wrap available to wrap around the object. It also creates a product that allows for the natural venting of the pallet. It also allows the film to be used in a concentrated area of the pallet.

The increase in stretch and gathering into strings of the stretch wrap results in a strong material that can hold together large loads while reducing the overall amount of stretch wrap used. So configured, efficiency of use of the stretch wrap increases. In addition, it provides for gaps between the stretch film which will allow the product to vent. These and other benefits may become clearer upon making a thorough review and study of the following detailed description.

BRIEF DESCRIPTION OF THE DRAWINGS

The above needs are at least partially met through provision of the stretch wrap dispenser described in the following detailed description, particularly when studied in conjunction with the drawings, wherein.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Figure 1:
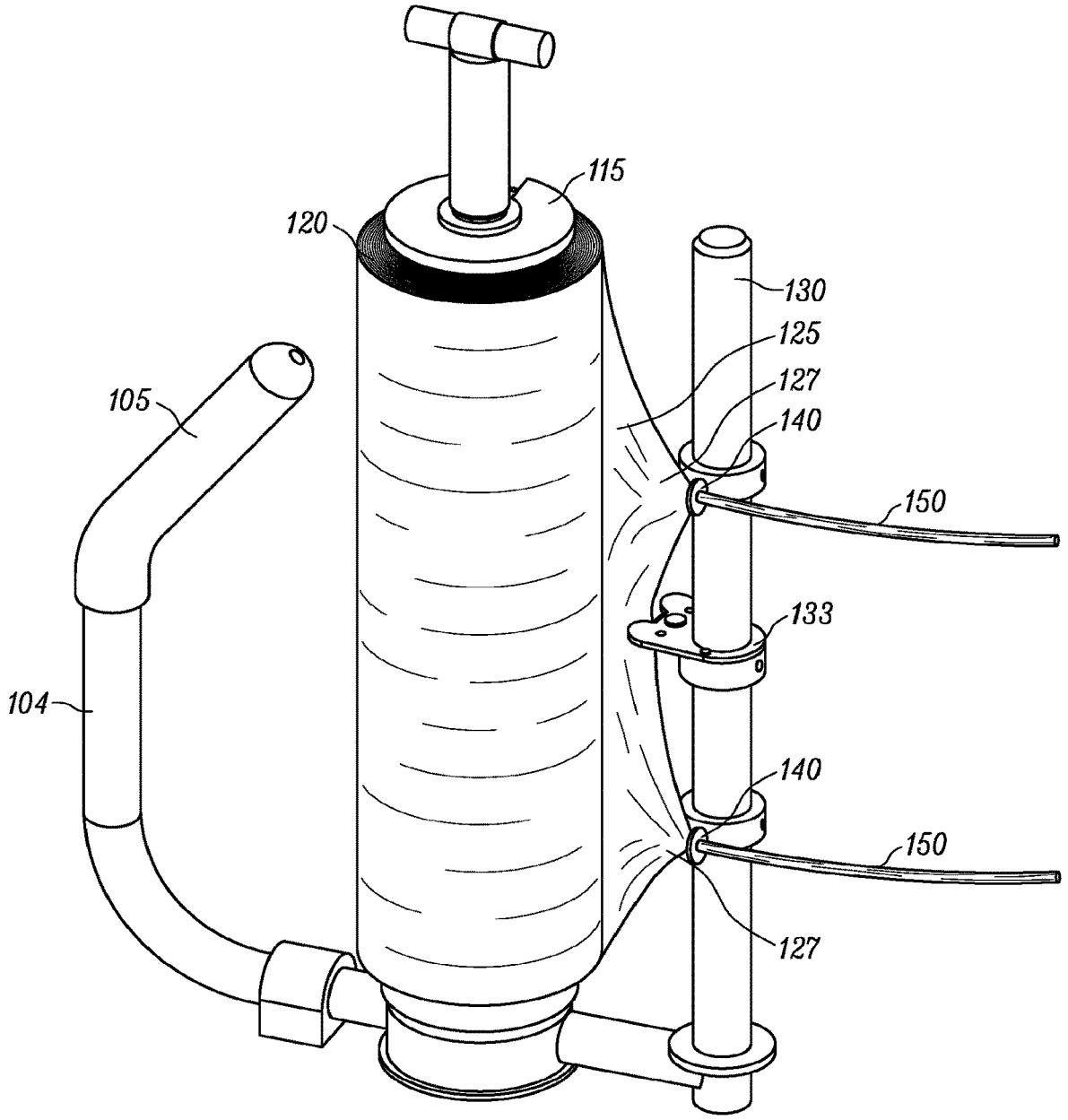
FIG. 1 Prior Art
FIG. 1 comprises a perspective view of a prior art stretch film dispenser.

Referring now to the drawings and, in particular to FIG. 1, a prior art stretch film dispenser with cutter is illustrated. The stretch film dispenser includes a frame 104 having a handle 105 extending from the frame. A rotatable support 115 is configured to engage and hold a roll 120 of stretch film and rotate with the roll 120 as the stretch film 125 is pulled and removed from the roll 120. The frame 104 also supports an elongated support member 130 that extends next to the roll 120. The support member 130 extends approximately parallel to the support 115 to be along a path between the stretch film 125 dispensed from the stretch roll 120 and the object to be wrapped or secured. A cutting member 133 is supported by the support member 130 and relative to the stretch film 125 to cut the stretch film 125 into two strips 127 upon removal from the roll 120. Two gathering devices 140 are disposed to stretch and gather the two strips 127 of stretch film 125 into strings 150 configured to wrap around the object.

Figure 2:
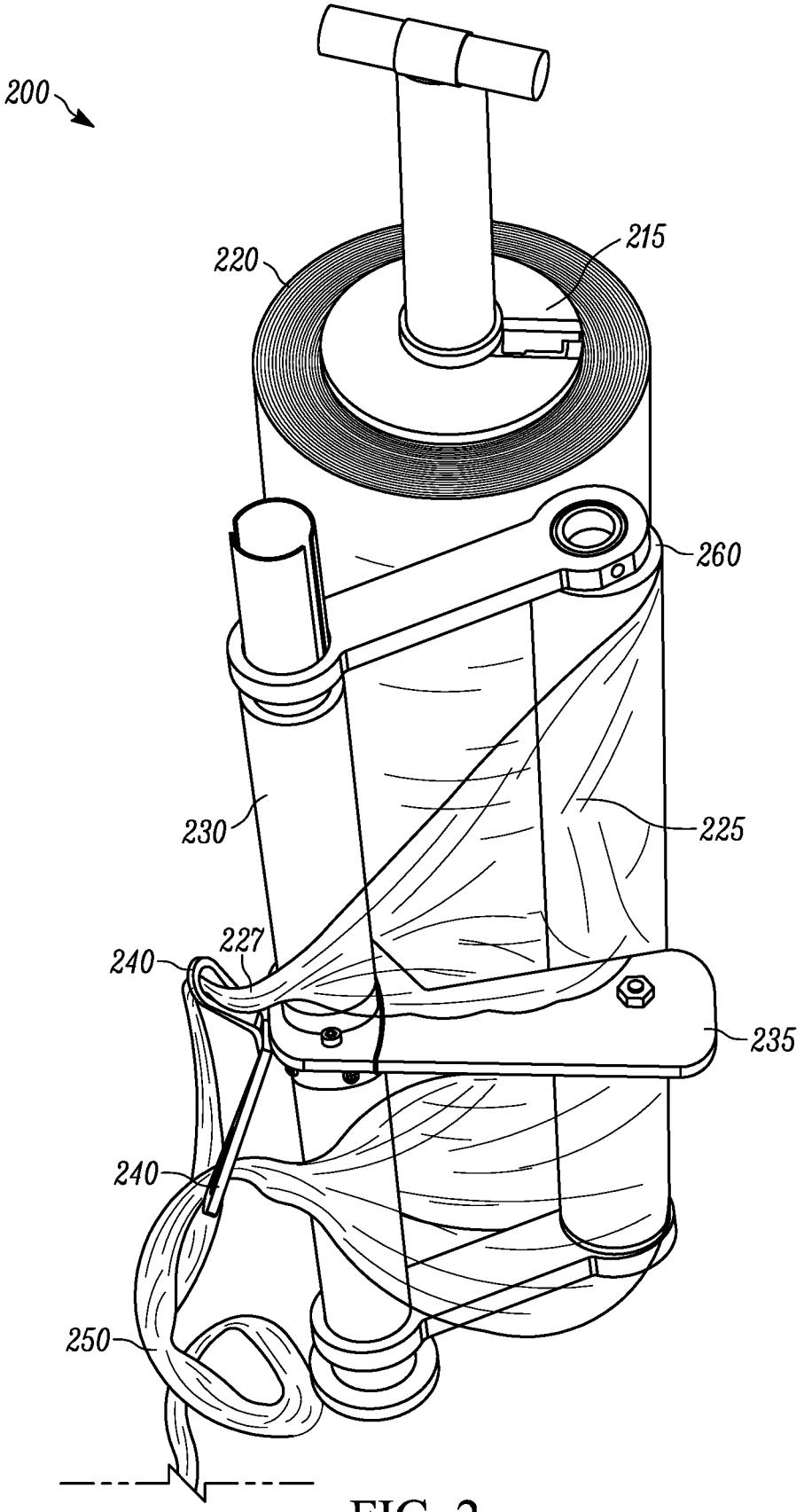
FIG. 2 comprises a top, front perspective view of an example stretch film dispenser as configured in accordance with various embodiments of the invention.
Figure 3:
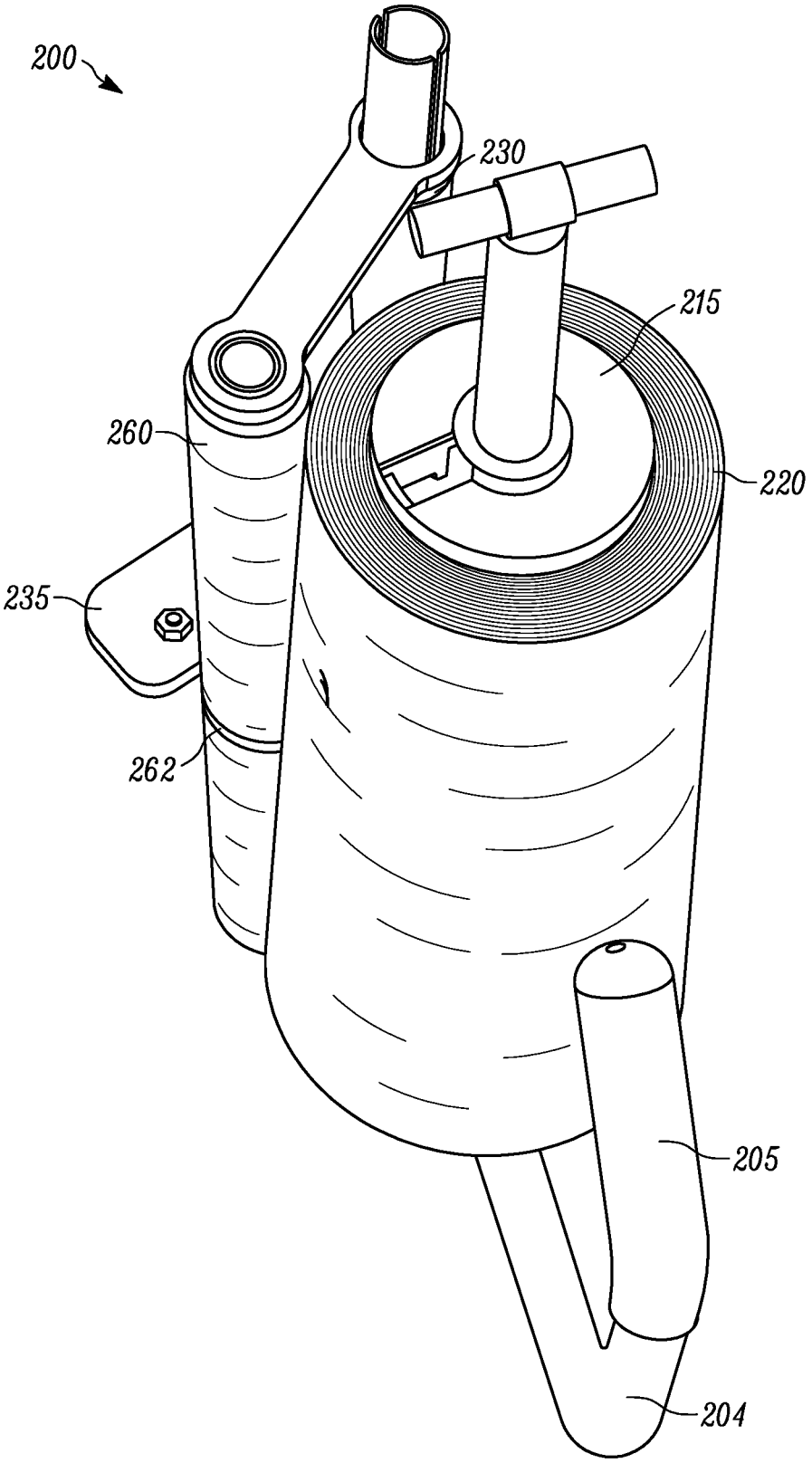
FIG. 3 comprises a top, back perspective view of the example stretch film dispenser of FIG. 2.
Figure 4:
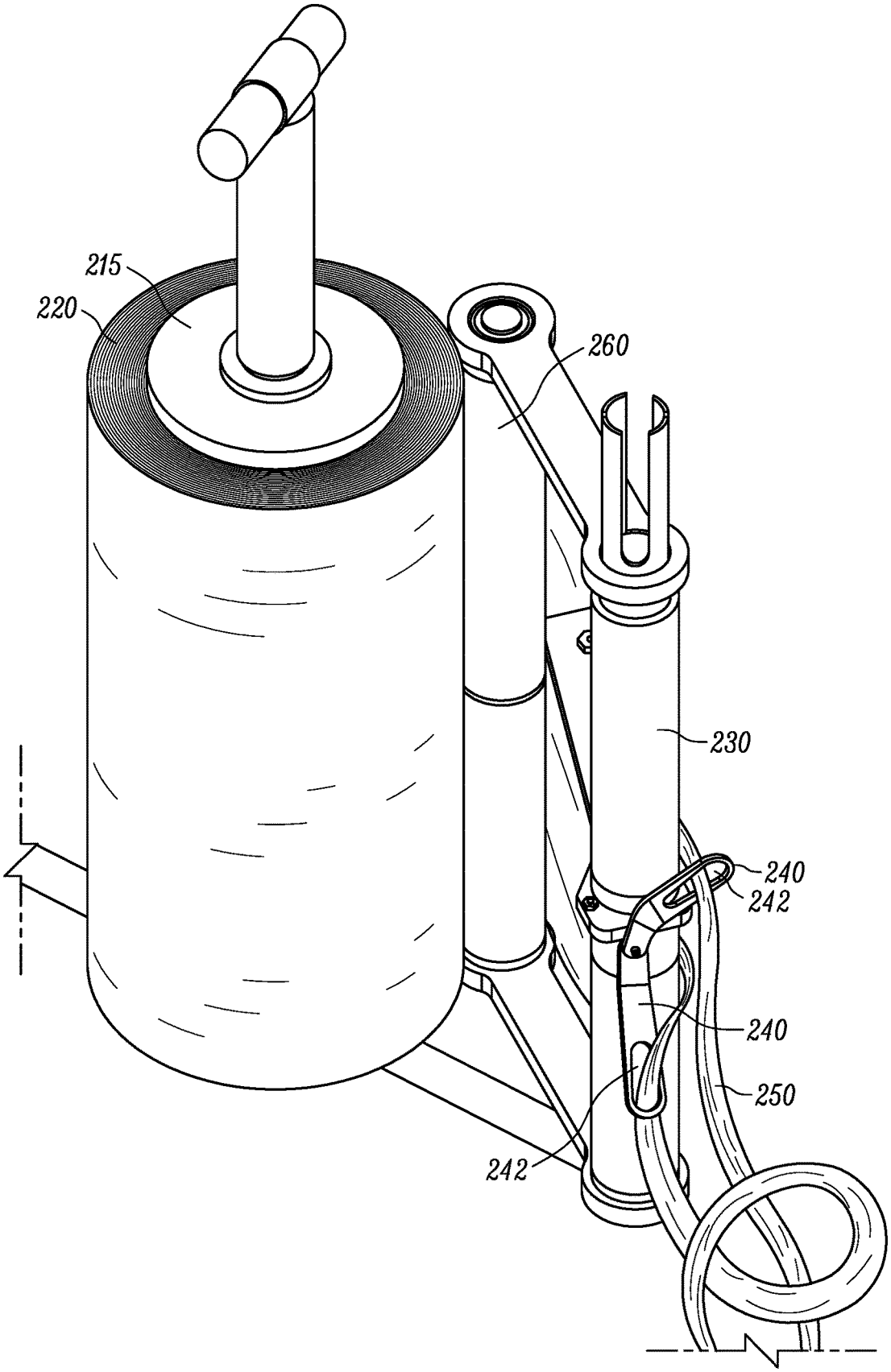
FIG. 4 comprises a top, left perspective view of the example stretch film dispenser of FIG. 2.

Referring now to FIGS. 2-4, an example, improved stretch film dispensing and stringer apparatus 200 for converting stretch film 225 into string or rope 250 is illustrated. The stretch film dispensing and stringer apparatus 200 includes a support frame 204 including an extension handle 205 that facilitates manual application of stretch film to an object. The frame 204 can be made of any suitable material such as a metal such as steel or plastic having sufficient strength to support the various aspects of the stretch film dispenser 200 against the forces experienced during stretch film application. Although described for a manual process, the teachings of this disclosure are not limited to hand application of stretch film and may be applied to mechanical or automatic application of stretch wrap or film to objects. A portion 215 of the support frame 204 is configured to rotatably support a roll of stretch film and dispense the stretch film in response to tension on the stretch film. The support 215 may be a rotatable arm or an elongated element such as using ball bearing support or the like designed to engage a hollow center of a stretch film roll, gripping members designed to engage either end of a stretch film roll, or other design suitable to support a roll 220 of stretch film for dispensing.

A roller 260 is supported in a biased manner toward the portion 215 of the support frame 204 that supports the stretch film roll 220 so as to engage the roll 220 of stretch film. The biased engagement of the roller 260 evens out the dispensing of the stretch film 225 from the roll 220 and provides a more consistent tension on the stretch wrap dispensed from the roll. The roller 260 is mounted in a rotatable fashion using roller bearings or other suitable structure known in the art such that the roller rotates as the stretch film 225 is dispensed and rolls over the roller 260. The roller also stretches and tensions the stretch film 225 as it wraps and moves around the roller 260. In one example, the roller 260 is one or more pre-formed plastic pieces to reduce adhesion between the stretch wrap 225 and the roller's surface although other materials can be used.

Figure 6:
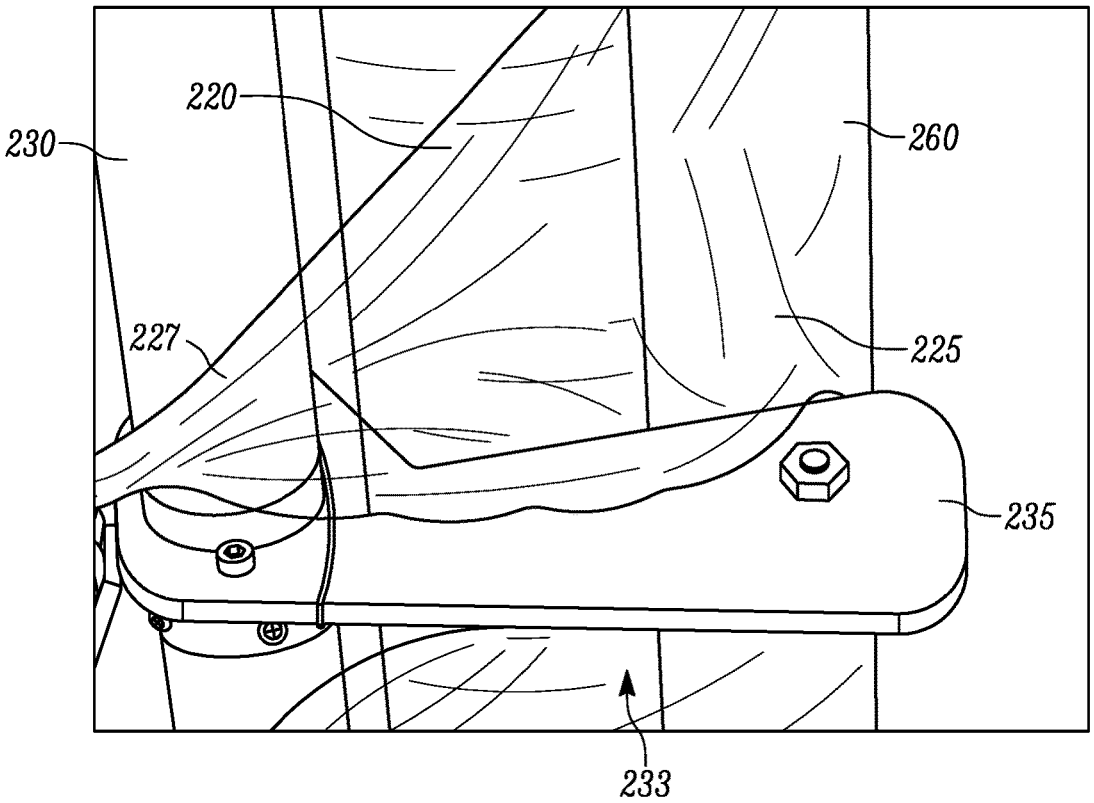
FIG. 6 comprises a perspective view of a portion of the example stretch film dispenser of FIG. 2 illustrating the cutting support.
Figure 7:
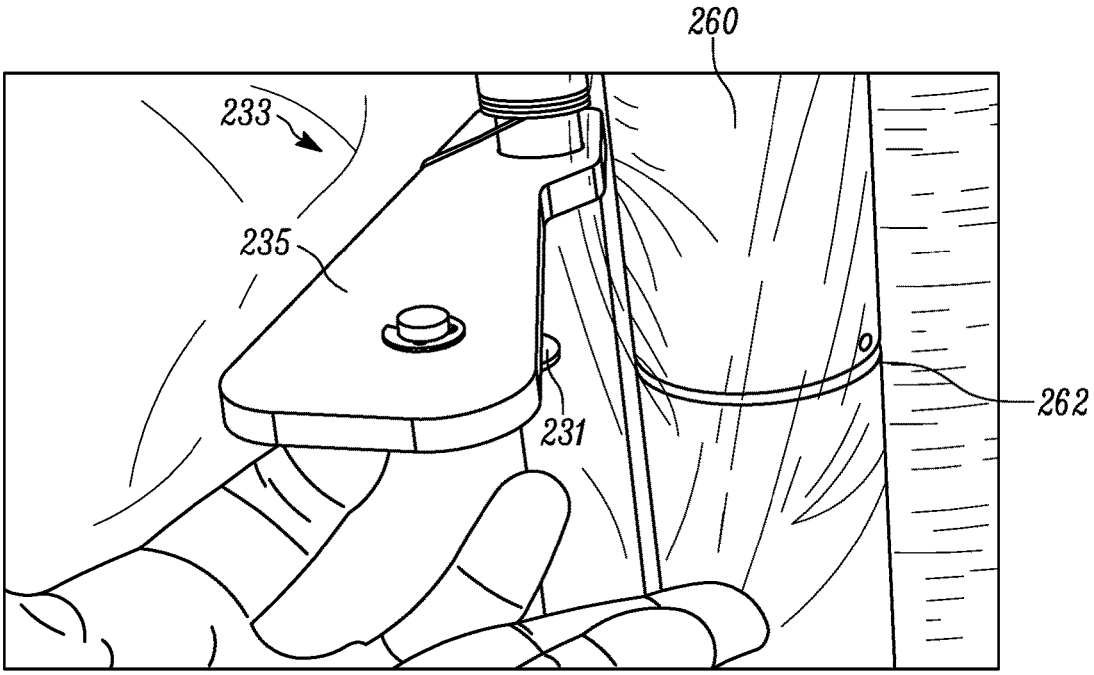
FIG. 7 comprises a perspective view of a portion of the example stretch film dispenser of FIG. 2 illustrating the cutting member and support separated from the groove.

One example of the cutting mechanism 233 will be described with reference to FIGS. 5-7. The cutting mechanism 233 includes a blade 231 supported in a biased manner toward the roller 260 such that at least a portion of the blade 231 inserts into a groove 262 defined by the roller 260. In the illustrated example, the blade 231 is supported by a blade support arm 235 that is biased toward the roller 260 so that the blade support arm 235 engages the roller 260. The blade 231 extends from the blade support arm 235 into the roller's groove 262. The roller 260 defines the groove 262 around its circumference so as to be able to receive the blade 231 continuously throughout its rotation. The groove 262 may be formed in a one-piece roller 260 or may be formed by a spacing between separate roller pieces that roll together with the stretch film. In one example, the blade 231 is a curved blade. By being disposed partially in the groove 262, the blade 231 reliably engages the tensioned stretch film 225 as it moves toward the blade 231 and between the roller 260 and the blade support arm 235 while the film 225 is stretched on the roller's surface. Although only one example of the cutting mechanism 233 is shown and described, it is contemplated that other arrangements for biasing a cutting blade toward the roller to effect a more consistent and cleaner cutting of the stretch film are possible.

Figure 5:
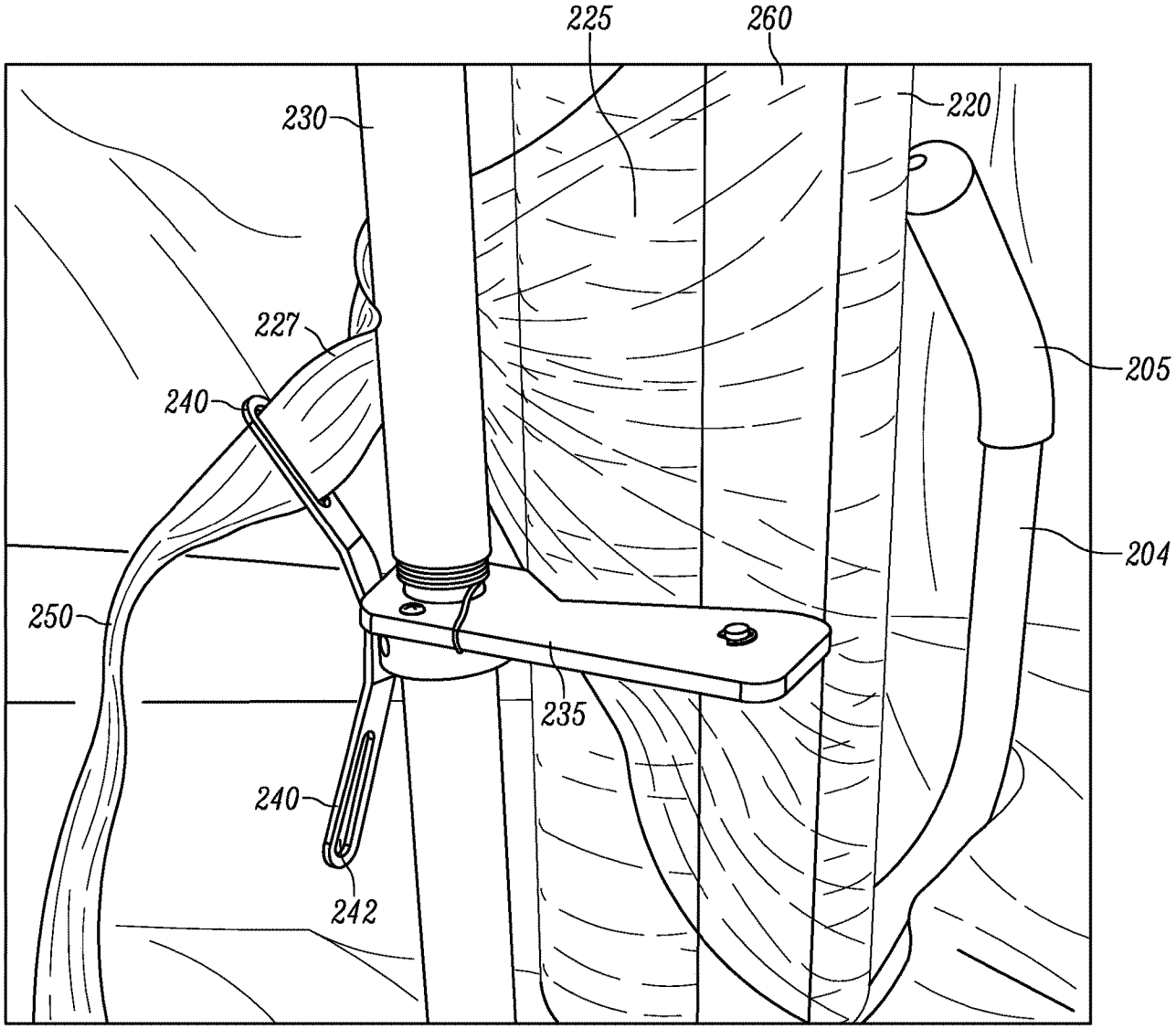
FIG. 5 comprises a perspective view of a portion of the example stretch film dispenser of FIG. 2 illustrating the cutting support and gathering devices.

Referring to FIG. 5, two gathering devices 240 disposed to individually receive, stretch, and gather the strips 227 into strings 250. In the illustrated example, the gathering devices 240 are metal (e.g., stainless steel or aluminum) members, each defining elongated and curved apertures 242 through which the cut strips 227 of stretch film pass. These narrow apertures effectively gather the strips 227 into ropes or string 250 while passing through the apertures 242. The stretch film will naturally partially stick to the metal of the gathering devices 240, thereby effecting additional stretching of the material as the strings 250 are pull through the apertures 242. The gathering devices 240 and their apertures 242 extend away from their support member 230 at an oblique angle, effectively toward an object to be secured by the string 250 dispensed from the device. Although the figures illustrate a device with only one cutting member 233 with two gathering devices 240, more cutting members and gathering devices may be disposed to cut additional strips to be formed into stretch film string. Moreover, a single gathering device 240 may be disposed to gather together two strips into single string or rope.

Additionally, other forms of the gathering device 240 are possible, including, for example, be rigid rings or washers secured to the support member. The inner round (although other shapes are possible) apertures of the rings or washers engage, gather, and provide and maintain tension on the stretch film as the strips pass through the apertures while moving toward the object to effect additional stretch and gathering of the stretch film into the elongated strings that are applied to the object. The inner apertures may comprise or be coated in a variety of materials to effect different stretching forces on engaging the stretch wrap. In another example, the gathering devices include two members supported by the support member and intersecting in a direction away from the support configured to support the roll. The two members and support member define an aperture disposed to direct one of the strips away from the roll. The two members may be two distinct members that are mechanically connected together to define the aperture with the support, or, in another approach, the two members may be separate legs of a single angled member that is mounted to the support to define the aperture.

In the illustrated example, a support member 230 extends approximately parallel (being sufficiently in line to facilitate the stretching and gathering operations along the width of the stretch wrap) to the portion of the support frame 215 that supports the stretch wrap roll 220. So disposed, the support member 230 sits along a path between the stretch film 225 dispensed from the stretch roll 220 and the gathering devices 240. By one approach, the support member 230 is fixedly attached to the support frame 104 in such a way that it provides positioning of the various elements of the dispenser 200 to facilitate reliable operation of the device.

For example, strip rollers can be rotatably supported by the support member 230 and disposed to rotatably engage the strips 227 between the roller 260 and the at least two gathering devices 240. Like the primary roller 260, the strip rollers are mounted in a rotatable fashion using roller bearings or other suitable structure known in the art such that the strip rollers rotate as the stretch film strips 227 move away from the cutting mechanism 233 and roll over the individual strip rollers. The strip rollers also stretch and tension the stretch film strips as they wrap and move around the strip rollers. In the illustrated example, there are separate strip rollers (one for each stretch film strip) mounted to the single support member 230 and are independently rotatable. In other approaches one strip roller may engage and stretch more than one stretch film strip. The strip rollers may each comprise one or more pre-formed plastic pieces to reduce adhesion between the stretch wrap and the strip roller's surface although other materials can be used.

Optionally, an extension handle 205 is disposed opposite of the support member 230 to facilitate manual operation and control of the stretch wrap 225 as it is applied to the object. Although only one example of the support member arrangement is shown, it is contemplated that the roller 260 and cutting mechanism 233 can be supported in other ways to be biased toward the stretch wrap roll 220 with the blade in the roll's groove to operate as described.

In still another example, the gathering members 240 include a rigid member mounted to the support member 230 and having a distal end extending away from the support that defines an aperture 242. The aperture 242 is configured to receive, gather, and stretch one of the strips 227 into one of the strings as the strips 227 pass through the apertures 242. In this example the rigid members made include any of a variety of materials having different flexibilities such that the rigid members may have some flex during the stretching and dispensing of the stretch film 225, but not so much flex that the rigid members are unable to direct the strings toward the object being secured. As with the above examples, the inner aperture 242 may comprise or be coated in a variety of materials to effect different stretching forces on engaging the stretch wrap 225 as it moves through the aperture 242. In still another approach, the gathering devices can be mounted so as to be rotatable to allow a user to selectively engage the gathering devices 240 mid-stream (during continuous dispensing of the stretch film) to apply un-gathered stretch film or gathered strings to a load. Examples of such gathering devices are described in U.S. Pat. App. Pub. No. 2014/0109525, titled Stretch Wrap Dispenser With Gathering Mechanism, published Apr. 24, 2014, which is incorporated by reference in its entirety.

So configured, the dispenser 200 is able to more reliably and consistently cut, stretch, and gather the stretch film 225 into stretched strings 250 having a significant tensile strength while also being stretched out enough to effect a savings in the amount of stretch wrap 225 used to wrap and secure a particular object. Such approaches can be advantageous for certain loads that need some air circulation and thus cannot withstand being fully sealed by the stretch film. Moreover, string or rope 250 gathered in this manner is more available to be un-gathered back into a flat stretch film 225 for further or reuse. In a different approach, the string or rope 250 can be rolled up onto a roll and stored as string or rope for later dispensing and use for securing object.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

What is claimed is:

1. A method for converting stretch film into string or rope, the method comprising:

while dispensing stretch film from a roll, rolling the stretch film over an idler roller biased toward the roll;

cutting the stretch film with a cutting member at least partially embedded in a groove of the idler roller to cut the stretch film along a length of the stretch film into at least two strips;

gathering with at least two gathering devices individual ones of the at least two strips into strings.

2. The method of claim 1 further comprising rolling the at least two strips over strip rollers before the gathering step.

3. The method of claim 1 further comprising biasing the cutting member toward to the roller so as to bias a blade of the cutting member into the groove.

* * * * *